US005598947A

United States Patent [19]

Smith

[11] Patent Number: 5,598,947

[45] Date of Patent: Feb. 4, 1997

[54] AUTOMATIC HOT FOOD VENDING MACHINE

[76] Inventor: Patrick Smith, 7726 W. Norton Ave., Los Angeles, Calif. 90046

[21] Appl. No.: 377,449

[22] Filed: Jan. 24, 1995

[51] Int. Cl.[6] ..... B65D 83/00

[52] U.S. Cl. ..... 221/150 HC; 221/150 A; 221/150 R; 221/2; 221/263; 221/265; 221/203

[58] Field of Search ..... 221/150 A, 150 HC, 221/150 R, 263, 264, 265, 224, 225, 2, 200, 203; 194/206, 207, 217; 99/357

[56] References Cited

U.S. PATENT DOCUMENTS

| | | | |
|---|---|---|---|
| 3,186,531 | 6/1965 | Adams | 194/206 |
| 3,224,643 | 12/1965 | White | 221/150 A |
| 3,534,676 | 10/1970 | Rubino | 221/150 HC X |
| 3,841,456 | 10/1974 | Levasseur | 194/217 |
| 4,225,056 | 9/1980 | Flubacker | 221/2 |
| 5,201,395 | 4/1993 | Takizawa et al. | 194/206 |

*Primary Examiner*—William E. Terrell
*Assistant Examiner*—Khoi H. Tran
*Attorney, Agent, or Firm*— Blakely, Sokoloff, Taylor & Zafman

[57] ABSTRACT

The unattended machine has a hopper for holding an inventory of uniformly-sized, individual, frozen or refrigerated portions of food and for maintaining the inventory in a frozen or refrigerated condition. Insertion into the machine of a genuine dollar bill is verified by an electro-optical mechanism which signals control and monitor circuitry to initiate food preparation by causing a microwave oven below the hopper to open and rotate into a food-receiving position below a dispenser, located below the hopper, which then dispenses an individual portion of food into the oven by gravity. The oven then rotates to a horizontal cooking position and closes its door, where the portion is heated by microwave energy for a pre-determined length of time. Upon completion of heating, the oven door is opened and the oven tilted downward and the heated portion of food is dispensed by gravity through an opening or port in the machine. Circuitry is provided for monitoring progress of the preparation and delivery cycle and for refunding purchase price in the event the machine is empty or a malfunction occurs. Additionally, the machine may be adapted for monitoring and recording machine status and for notifying a remote location telephonically of problems or maintenance needs.

9 Claims, 6 Drawing Sheets

Fig. 10.
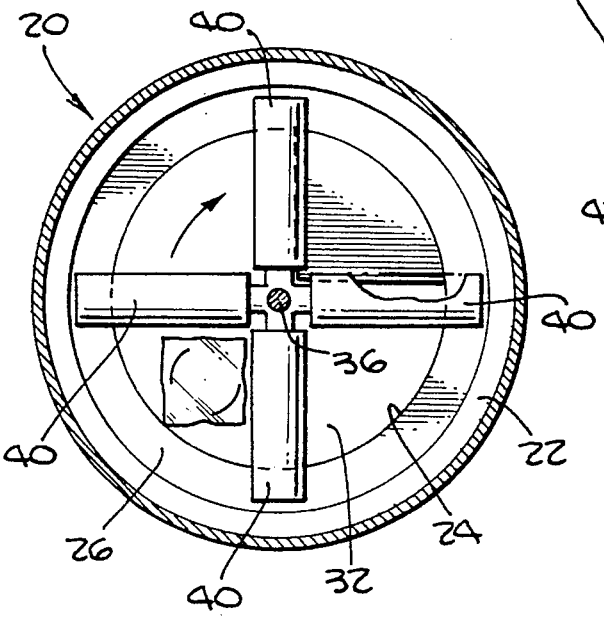
Fig. 11.
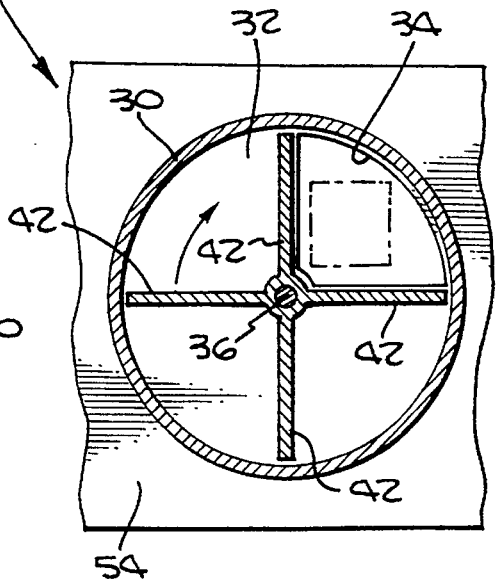
Fig. 8.
Fig. 9.
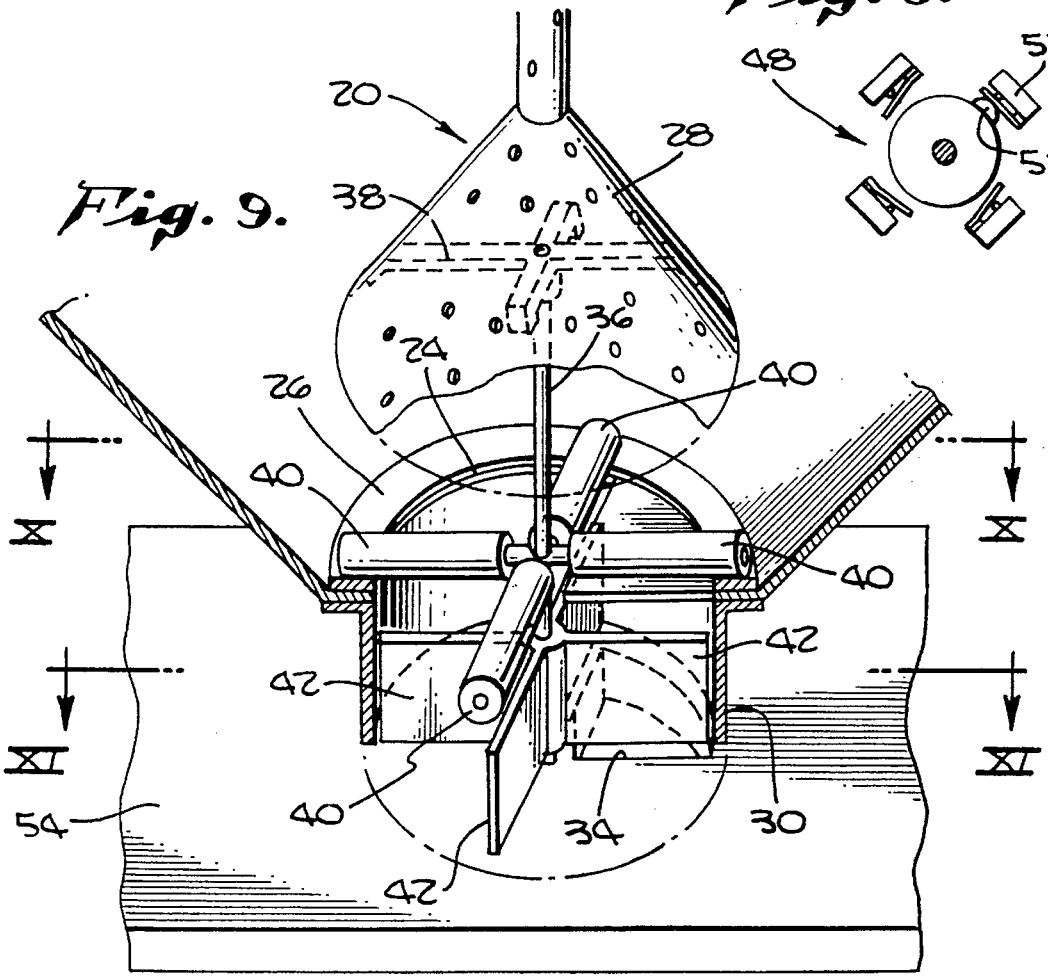

AUTOMATIC HOT FOOD VENDING MACHINE

BACKGROUND OF THE INVENTION

1. Field of the Invention

This invention pertains, in general, to automata, and in particular, to an automatic machine for vending individual portions of hot food, such as sandwiches, potatoes, soups or the like.

2. Description of the Related Art

The rapid growth of the fast food industry in this country has not completely satisfied a demand for readily-accessible, round-the-clock sources of fast, hot food, particularly in remote locations or where the demand or space available does not warrant a manned kitchen. So-called "Automats" have not filled this void either because, despite their semi-automatic nature, they are still relatively labor-intensive.

Neither has the vending machine industry completely satisfied the need for ready access to hot, fast food. One known example of an effort to fill this gap by the vending industry is the infrequently-seen vendor of preheated, canned products, such as soup, chili, etc. The limitations of this machine are that the product is confined to canned commodities and lacks the potential freshness capability of a machine purveying a freshly prepared, flash-frozen product.

Another example of prior efforts are those machines which vend refrigerated sandwiches and the like, which products must then be manually heated or cooked by the patron in associated, but independent, heating apparatus, e.g., a microwave range.

It is therefore an object of the present invention to provide an automatic hot food vending machine capable of storing an inventory of individualized portions of freshly-prepared, flash-refrigerated or frozen food, and for quickly heating or cooking at least one of those portions and vending it to a patron on a completely automatic basis.

It is another object of the present invention to provide such a machine that is relatively inexpensive to fabricate and assemble, yet which achieves a high degree of reliability in the field.

It is yet another object of the present invention to provide such a machine which is easily maintained and may be tended in relatively large numbers by a single tender.

SUMMARY OF THE INVENTION

These, and other objects and advantages of the present invention are preferably accomplished by the provision of a combination apparatus comprising hopper means for holding an inventory of uniformly-sized, individual, frozen portions of food and for maintaining that inventory in a frozen condition, dispenser means for selectively dispensing one of the refrigerated portions from the inventory by gravity, and oven means for receiving the portion from the dispenser means and for heating it by radiation with microwave energy for a predetermined length of time, then discharging the heated portion from the apparatus by gravity. In further combination, changer means are provided for receiving, counting, authenticating and storing paper currency inserted into the apparatus and for refunding counterfeit or genuine money upon demand, and monitor and control means for initiating the food preparation cycle and for monitoring the progress of the cycle to insure that the patron is ultimately served with the portion of heated or cooked food that has been paid for.

In a narrower embodiment, an apparatus is provided which is capable of monitoring and recording machine status, including inventory and, in an appropriate case, notifying a remote location, e.g., by telephone, of the machine's status or a malfunction.

Skilled practitioners will derive a more complete understanding of the invention from a consideration of the following detailed description of the preferred embodiments, particularly if it is read in conjunction with the appended drawings, a brief description of which now follows.

BRIEF DESCRIPTION OF THE DRAWINGS

FIG. 8 is a top view into a means for controlling consecutive 90° incremental rotations of a shaft within the dispenser means as revealed by the section VIII—VIII taken in FIG. 7;

FIG. 9 is a front, perspective, partial sectional view of a dispenser means for the machine in which sections X—X and XI—XI are taken;

FIG. 10 is a sectional view through the dispenser means as revealed by the section X—X taken in FIG. 9;

FIG. 11 is another partial sectional view through the dispenser means as revealed by the section XI—XI taken in FIG. 9;

DESCRIPTION OF THE PREFERRED EMBODIMENTS

Figure 1:
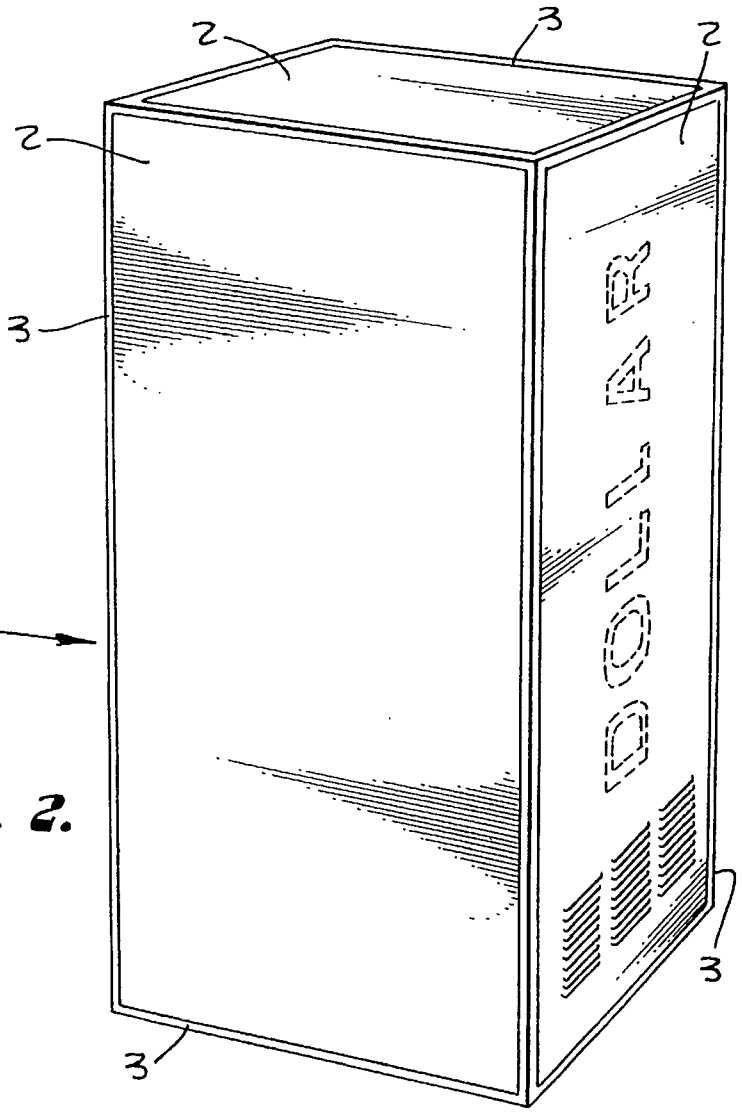
FIG. 1 is a front and side perspective view of a vending machine in keeping with the subject of the present invention.
Figure 2:
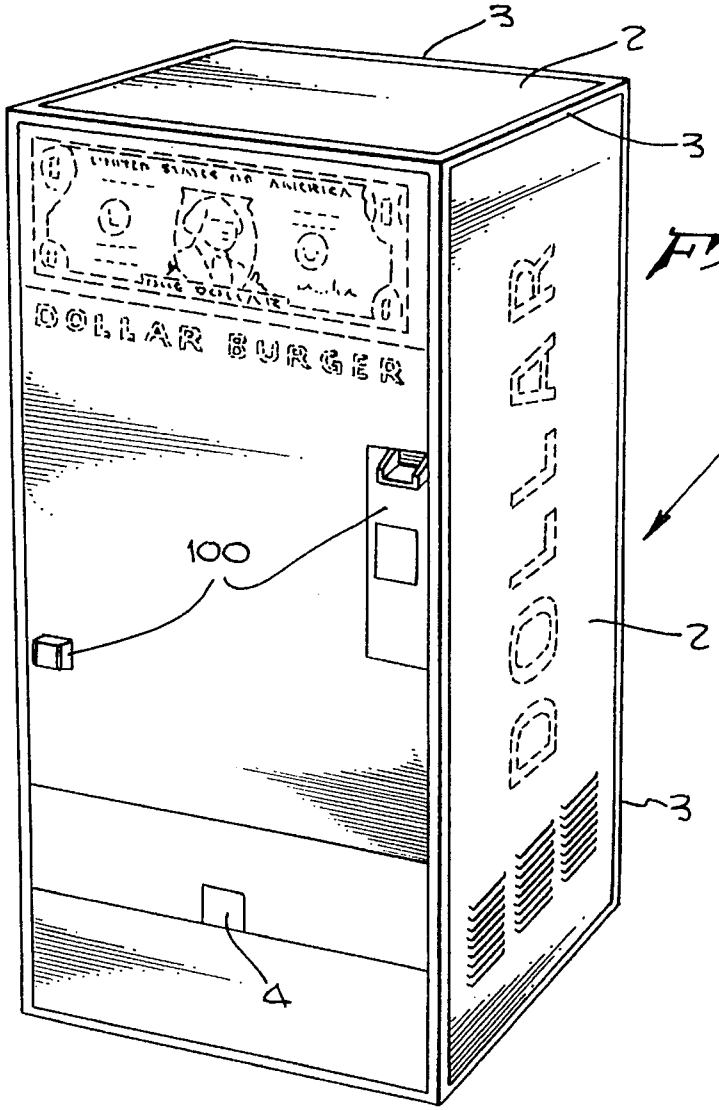
FIG. 2 is a rear perspective view of the machine.

A perspective view of an exemplary preferred embodiment of a machine 1 in keeping with the present invention is illustrated generally at FIGS. 1 and 2. The exterior of machine 1 comprises a plurality of galvanized steel panels 2 which are assembled together at their edges by means of extruded or formed aluminum or steel channel stock 3 by use of rivets, fasteners or the like, in a manner known in the art. Preferably, one of panels 3, e.g., the front panel, is hingably attached to machine 1 in a lockable engagement to permit maintenance access to the internal components of machine 1 by a tender.

Figure 3:
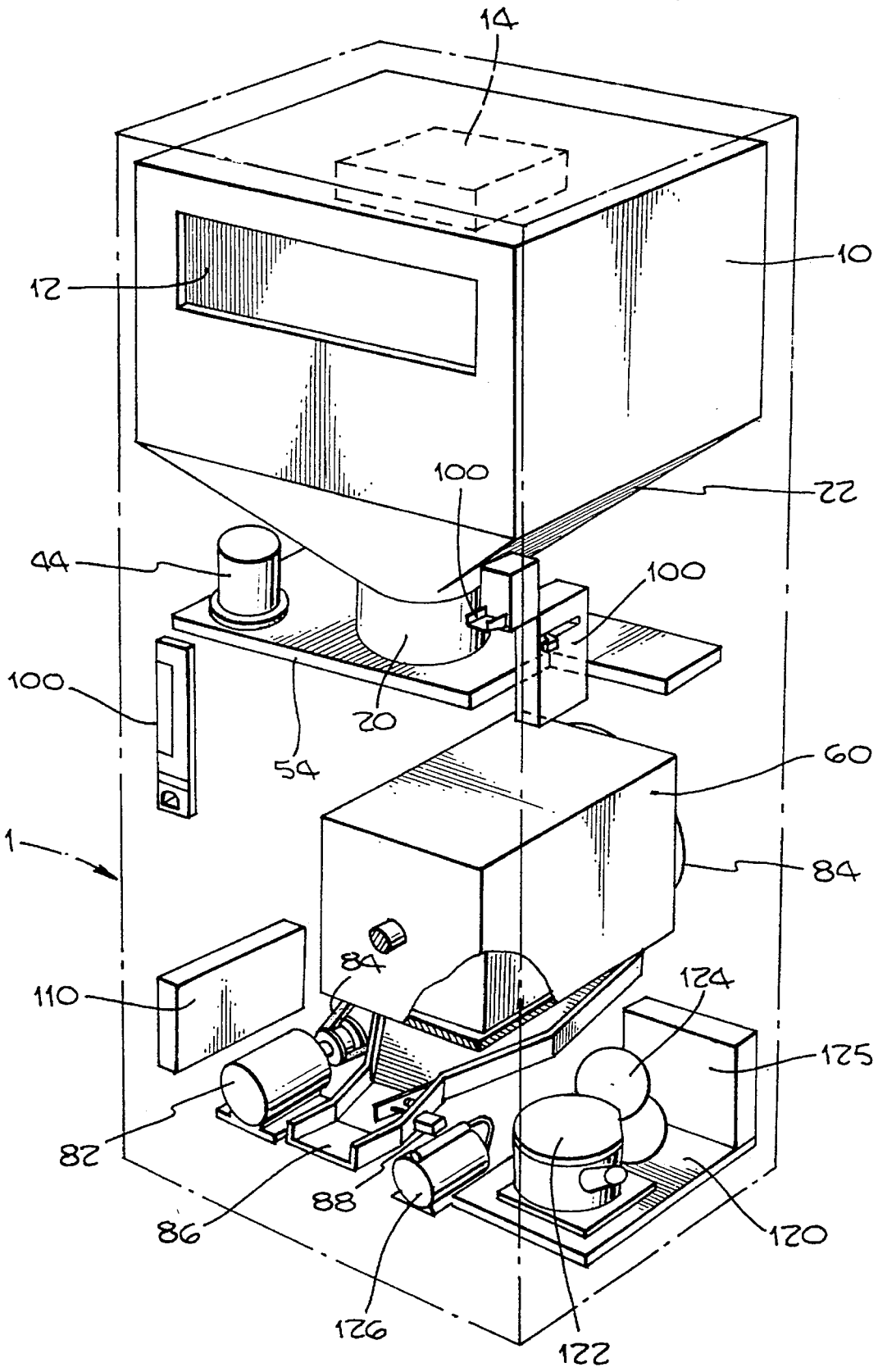
FIG. 3 is a cutaway perspective view looking into the front and side of the machine.

FIG. 3 illustrates the major components of machine 1 in their correct positional relationships, with the outline of machine I shown in phantom lines. The major components of machine I comprise a bin or hopper means 10 for holding an inventory of uniformly sized, individual, frozen or refrigerated portions of food and for maintaining the food inventory in a frozen or refrigerated condition; dispense means 20 for selectively dispensing one of the portions from the hopper means 10 by gravity, oven means 60 for receiving the dispensed portion, heating the portion with microwave energy for a predetermined length of time, and discharging the heated portion from the machine by gravity; and, additionally, machine 1 includes changer means 100 for receiving, counting, authenticating, and storing money inserted into the machine and for refunding counterfeit money and coin upon demand, as well as monitor and control means 110 for initiating the cooking or heating sequence upon a determination that an appropriate amount of genuine money has been inserted in changer means 100. Support equipment located in the lower portion of machine 1, preferably on an upper surface of a floor panel of machine 1, include conventional refrigeration means, including a compressor 122, refrigerant containers 124, a condenser 125, and means 126 for supplying a source of compressed air.

In the exemplary preferred embodiment illustrated, hopper means 10 comprises a rectangular, insulated bin for holding an inventory of randomly-stacked, uniformly sized, individual, frozen or refrigerated portions of a food product, e.g., hamburgers, hot dogs or other sandwiches or prepackaged soups, e.g., chili, etc. Loading access to hopper means 10 is by way of a loading aperture 12 at the front of the machine and behind the machine's front panel. Evaporator means 14 located at the top of the bin provide the desirable cooling effect to maintain the inventory of food portions at the desired temperature, preferably in a range from about between 0° F. and 40° F. The exemplary embodiment illustrated has a generally cubic shape at the top and the dimensions of about 36" by 27" by 16" high, and with the transition section (discussed below), is capable of holding an inventory of about 200–220 prepackaged hamburgers of conventional size in random order. The bin of hopper means 10 is preferably fabricated from food-grade stainless steel and insulated by use of blown-in-place polyurethane foam insulation.

Dispenser means 20 of the present invention, and their operation, are best illustrated in FIGS. 6–11. Dispenser means 20 includes a lower transition section 22 in hopper means 10 configured in the shape of an inverted frusto-pyramidal or frusto-conical chamber having a flat bottom 26 with a semicircular opening 24 comprising ¾ths of a circle closed by a quadrant shaped closure 25. The flat bottom and semicircular opening 24 define an inwardly- flanged lip 26 about opening 24. It is preferable that the opening 24 have a diameter of at least about twice that of the largest dimension of one of the portions of the food to be dispensed.

A funnel-shaped, upright conical member 28 having a largest diameter about equal to that of opening 24 is supported by cross bar 29 generally centered within transition region 22 and above and spaced apart from opening 24. Conical member 28 may be fabricated from a variety of materials, and both plastic and stainless steel have been used successfully. The purpose of conical member 28 is to act in conjunction with gravity and the shape of transition region 22 to distribute and channel food portions into the area of opening 24. Accordingly, the size of conical member 28 and its spacing from transition walls 22 and opening 24 will depend upon the largest dimension of an individual food portion, and preferably will be spaced normally from transition walls 22 at a distance smaller than a portion's largest dimension and greater than the portion's smallest dimension, and will be spaced from opening 24 by an amount at least slightly larger than a portion's largest dimension.

A cylindrical pan 30 is positioned directly below opening 24 and has a diameter coextensive with that of opening 24 and is in direct communication with it. Cylindrical pan 30 has a generally flat bottom 32 having a quadrant-shaped aperture defining a dispenser opening 34 therethrough in vertical alignment with quadrant shaped closure 25 and a depth slightly larger than the largest dimension of an individual food portion. It is preferable that cylindrical pan 80 be fabricated from a food- compatible alloy of stainless steel, both for cleanliness purposes and for insulation.

Dispensing means 20 further comprises an elongated vertical shaft 36 extending from a bushing in a spider 38 mounted to the underside of conical member 28, down through opening 24, cylindrical pan 30, and floor 32 of cylindrical pan 30, to be rotatably retained at its lower end by a bushing 39.

A quartet of elongated rollers 40 extend radially outward from shaft 36 in even distribution in a common plane normal to shaft 36 above opening 24. An outer portion of rollers 40 is in rolling contact with an upper surface of flanged lip 26 such that, when shaft 36 rotates in the direction of the arrow indicated in FIGS. 10 and 11, rollers 40 move with a rolling motion over semicircular opening 24. Rollers 40 serve to stir the distributed food portions accumulating near the mouth of opening 24 and to urge them toward it and are preferably constructed of a hard rubber material reinforced internally with an elongated steel sleeve to serve as a bearing.

A paddle wheel having four paddles 42 is mounted to shaft 36 below rollers 40 and has the paddles extending radially outward from shaft 36 in axial alignment with rollers 40. Paddles 42 each have a width and radial extent sufficient to sweep substantially all of a quartic volume defined within cylindrical pan 30 between adjacent paddles 42 into alignment with dispenser opening 34 upon successive 90° incremental rotations of shaft 36.

Figure 7:
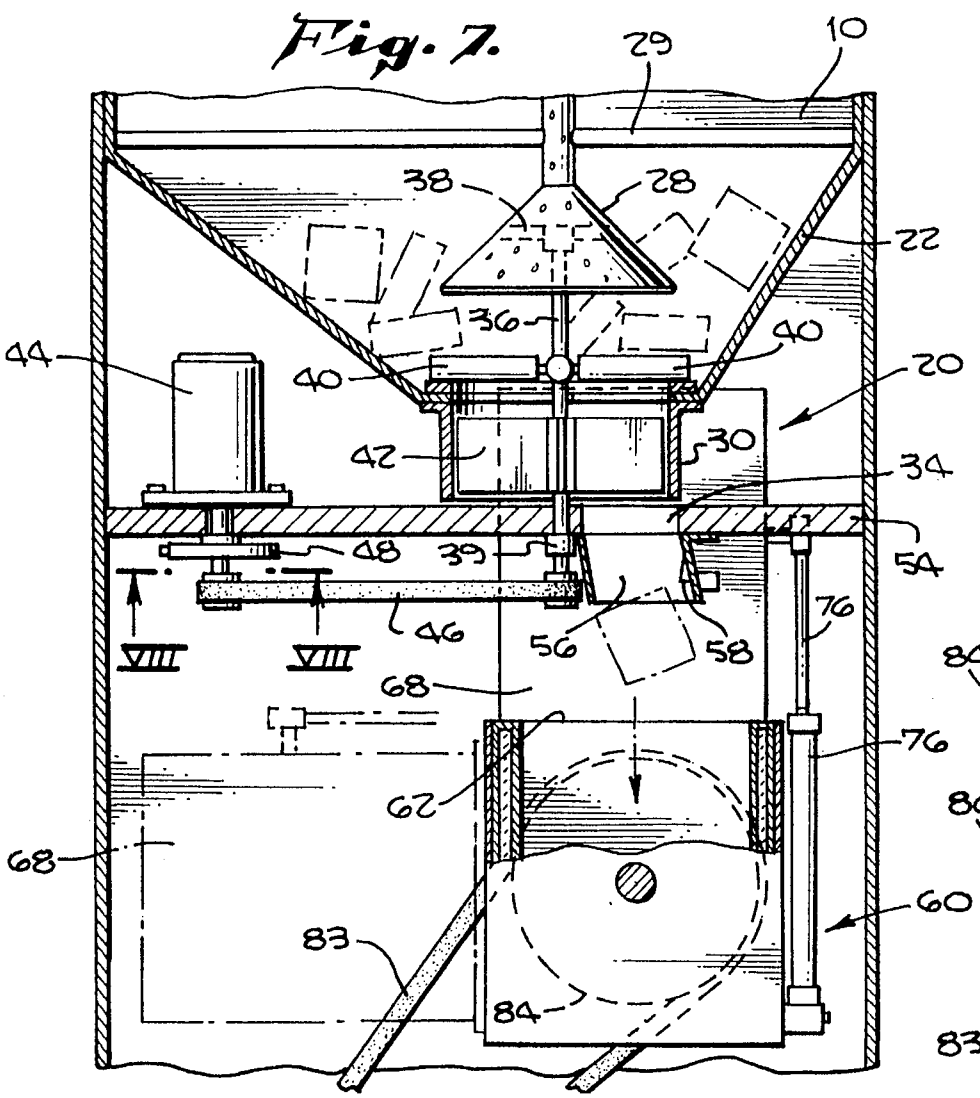
FIG. 7 is a partial sectional view into the front of the machine, as revealed by the section VII—VII taken in FIG. 6.

Means for selectively rotating shaft 36 through successive 90° incremental rotations when activated are illustrated in FIGS. 7 and 8, and include an electric motor 44 driving shaft 36 by means of a belt-and-pulley arrangement 46. Dispenser motor 44 additionally drives means 48 for detecting successive 90° incremental rotations of shaft 36 and deactivating motor 44 at the end of each said incremental rotation. Detecting means 48 includes a cam wheel 50 having a nose part 51 operating in association with four evenly-distributed limit switches 52 operating to shut motor 44 off after a 90° incremental rotation of shaft 36. In the exemplary embodiment discussed herein, two such cam wheels 50 are provided operating in parallel with motor 44 and control- and-monitor means 110 as a form of redundancy in the event of a failure of one of the individual limits switches 52.

Dispenser means 20 further includes a mounting plate or bracket 54 extending laterally through the upper mid-portion of machine 1. Mounted on the underside thereof is a dispenser chute 56 adapted to catch a dispensed portion of food from dispenser means opening 34 and convey it to ovens means 60 below. Mounted within chute 56 are means 58 for detecting whether or not a portion of food has been dispensed from dispenser means 20 after a 90° incremental rotation of shaft 36, and in the embodiment illustrated, comprises a switch for generating a signal to control and monitor means 110 to reactivate dispenser means 20 for one or more 90° incremental rotations of shaft 36 until a dispensed food portion has been detected. Control and monitor means 110 (discussed hereinafter), includes means for counting the number of successive 90° incremental rotations of shaft 36 after which a portion of food has not been dispensed and, after a predetermined number thereof, for making the electronic presumption that hopper means 10 is empty or that dispenser means 20 is jammed and for signaling changer means 100 (discussed hereinafter) to refund the patron's money.

Oven means 60 and its operation relative to the other components of machine 1 are illustrated best in FIGS. 4–7 and 12–14.

Generally, oven means 60 comprises an enclosure 62 below dispenser means 20 which is shielded against passage of microwave energy, means for receiving a portion of food dispensed from dispenser means 20 into shielded enclosure 62, means for radiating microwave energy into enclosure 62 for a predetermined length of time, and means for discharging the heated portion from enclosure 62 and out of machine 10 by gravity.

In the exemplary preferred embodiment illustrated in the figures, oven means 60 includes a conventional, domestic microwave oven 62. Brands of ovens which have been used successfully and which have shown good reliability in hard, commercial use are a Litton® Model No. FS-7EVP (700 watts), a Sharp® Model No. R-22BP (1000 watts-"Heavy Duty Commercial"), and a Sanyo® Model No. "Commercial Sandwich" (700 watts.) These conventional ovens typically are rectangular in shape and include a front face 64 having an opening 66 coextensive in area with the oven's rectangular interior volume 67. Enclosure 62 is typically accessed by a hinged door 68 which, when in a fully-closed position (see FIG. 5), provides a cooking and heating enclosure 62 completely shielded against passage of microwave energy. This energy is typically provided by a klystron adapted to radiate into internal volume 67 through an aperture at the top of the internal volume 67. Cooking or heating times are timed by a timer mechanism 70 which is typically integral of these domestic ovens. This timer may be internally modified to preset for the cooking time required for the particular product being vended, and for a typical hamburger portion, comprises 40–55 seconds for the makes and models of ranges indicated above. However, if it is preferable to keep the oven as "stock" as possible, the timing of the cooking cycle may be established by means for mechanically setting timer 70, such as the solenoid-actuated tapping bar mechanism 72 illustrated in the figures. In this case, the amount of time programmed for cooking may be "preset" for the particular kind of food being cooked or heated by adjustment of the vertical position of tapping bar mechanism 72 relative to timer 70. In the exemplary preferred embodiment illustrated, a switch 73 is set to detect the amount of time being programmed into the oven by tapping bar mechanism 72 and report that amount to control and monitor means 110. Additionally, in the embodiment illustrated herein, control and monitor means 110 includes a second, electronic timer operated in parallel with oven timer 70 as a form of redundancy.

Figure 4:
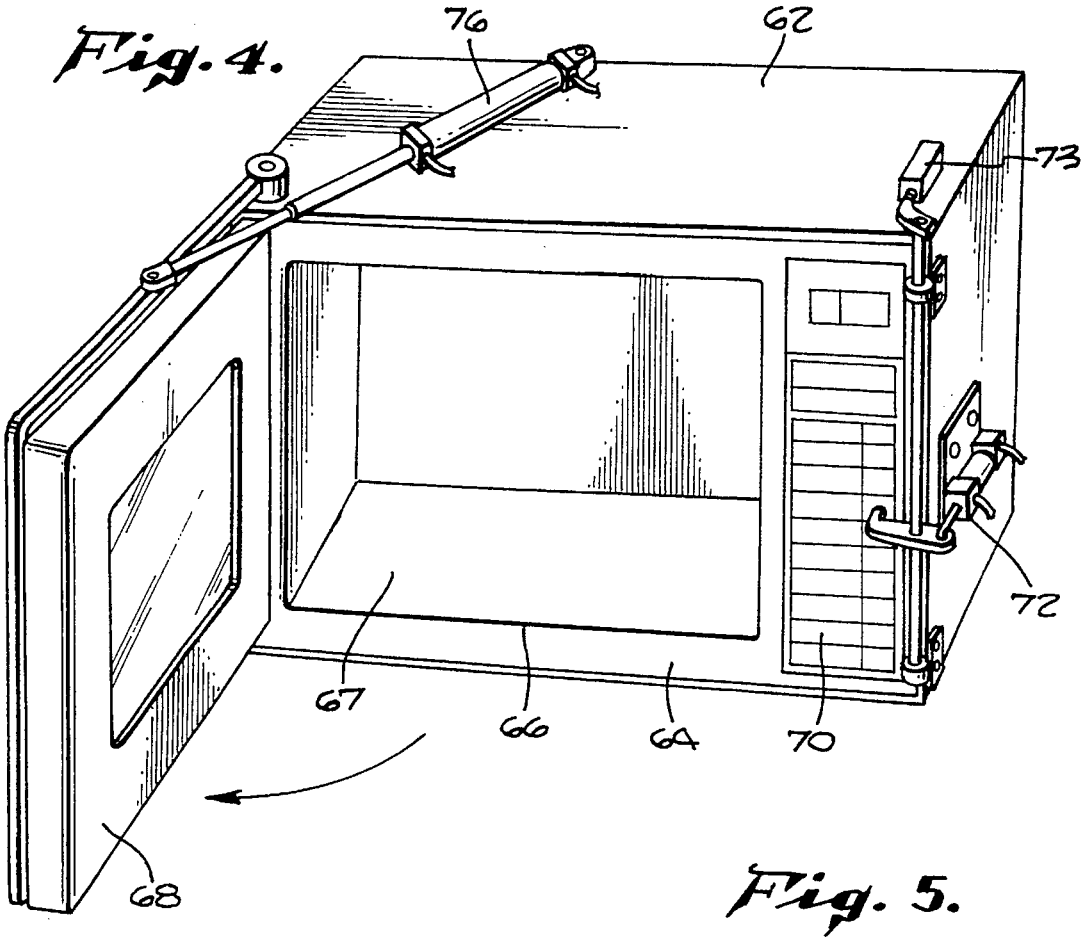
FIG. 4 is a front perspective view of a microwave oven means utilized within the present invention, showing the door of the oven in an open position.
Figure 5:
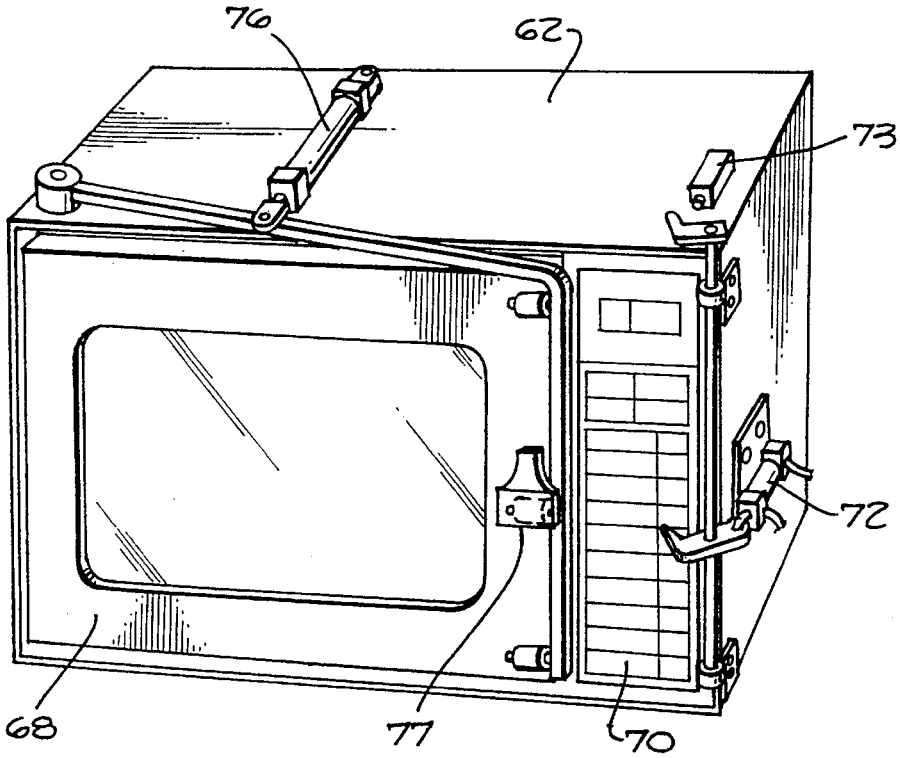
FIG. 5 is another perspective view of the oven of FIG. 4 with the door shut.
Figure 6:
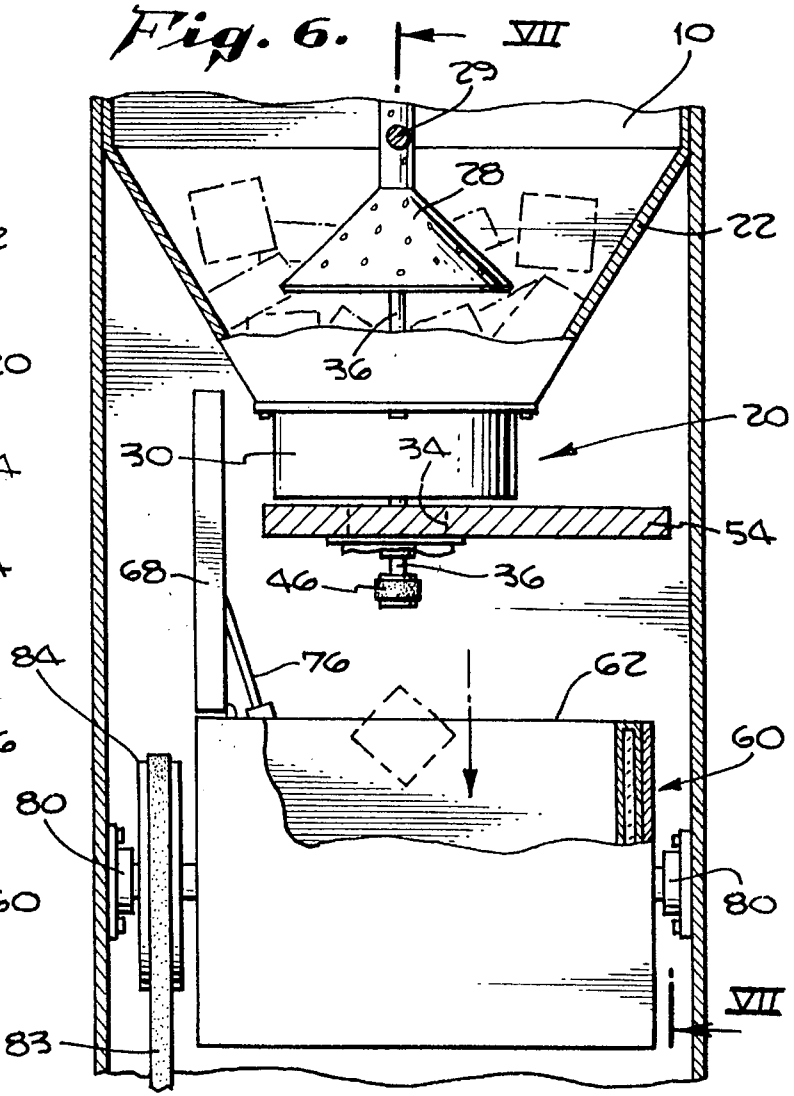
FIG. 6 is a partial sectional view looking into the side of the machine and wherein the section VII—VII is taken.

When a conventional oven of the type illustrated in FIGS. 4 and 5 is utilized within machine 1, some means are required for opening door 68 to receive the portion of food for heating or cooking or to discharge the heated portion from the oven, and some means are required to close door 68 during the heating portion of the cycle. In the embodiment illustrated, means for opening and closing door 68 comprise a pneumatic, hinged-solenoid-and-bracket arrangement 76 as illustrated, and, if the oven includes a safety latch of the type typically provided with a conventional oven, may also include an electromagnetic-solenoid-actuated unlatcher 77 operating in series therewith.

In addition to providing means 76 for opening and closing oven door 68 and for setting timer mechanism 70, some means must be provided for orienting oven means 60 in order to receive a portion of food to be heated and to discharge the portion after heating. The means for accomplishing this in the exemplary embodiment are illustrated best in FIGS. 12–4. In order to receive a portion of food for cooking, or to discharge it after cooking, enclosure 62 is rotatably-journaled about a horizontal axis by a pair of shaft-and-bearing assemblies 80 for rotation between an upward-facing position directly below dispenser means opening 34, a horizontally- facing position for cooking or heating, and a downward-facing position for product discharge, and is driven through those positions by means of a reversible electric motor 82, which drives enclosure 62 through a belt-and-pulley system 83. As in the case of the dispenser drive means 44 and 46, the drive mechanism of oven means 60 includes a circular cam 84 with a nose part operating in association with a trio of limit switches 85 which serve to deactivate motor 82 when enclosure 62 is rotated to the correct position of orientation, and, as in the case of the dispenser drive, cam wheels 84 and limit switches 85 are provided in parallel pairs for redundancy purposes.

Figure 12:
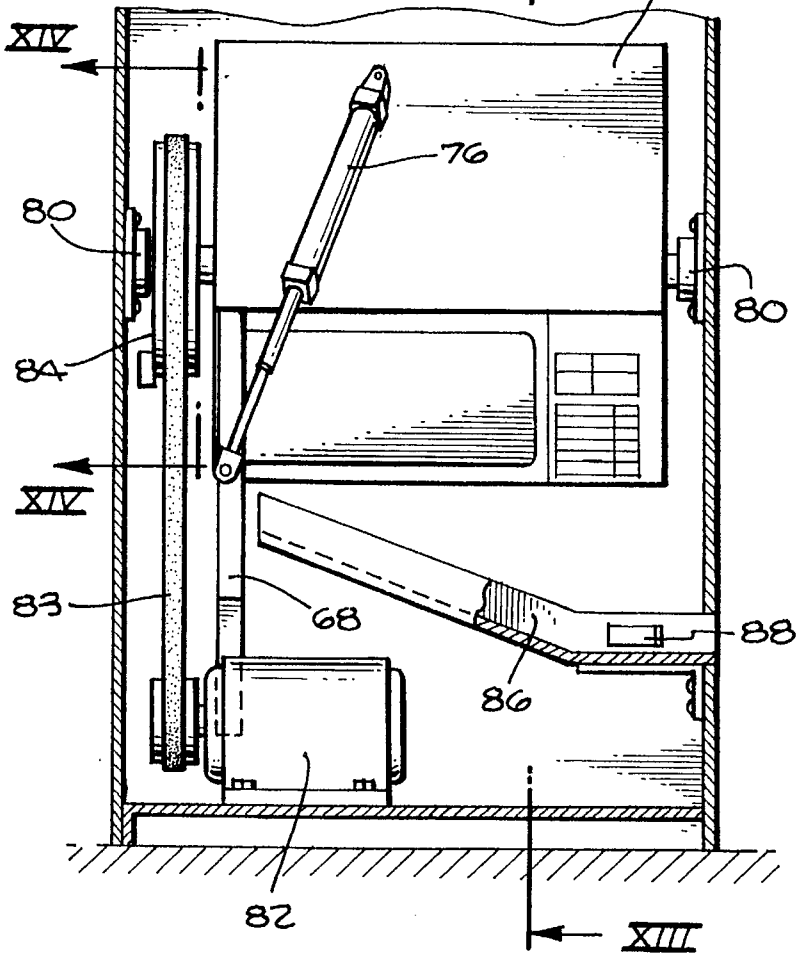
FIG. 12 is a partial side section looking into the machine within which sections XIII—XIII and XIV—XIV are taken.
Figure 13:
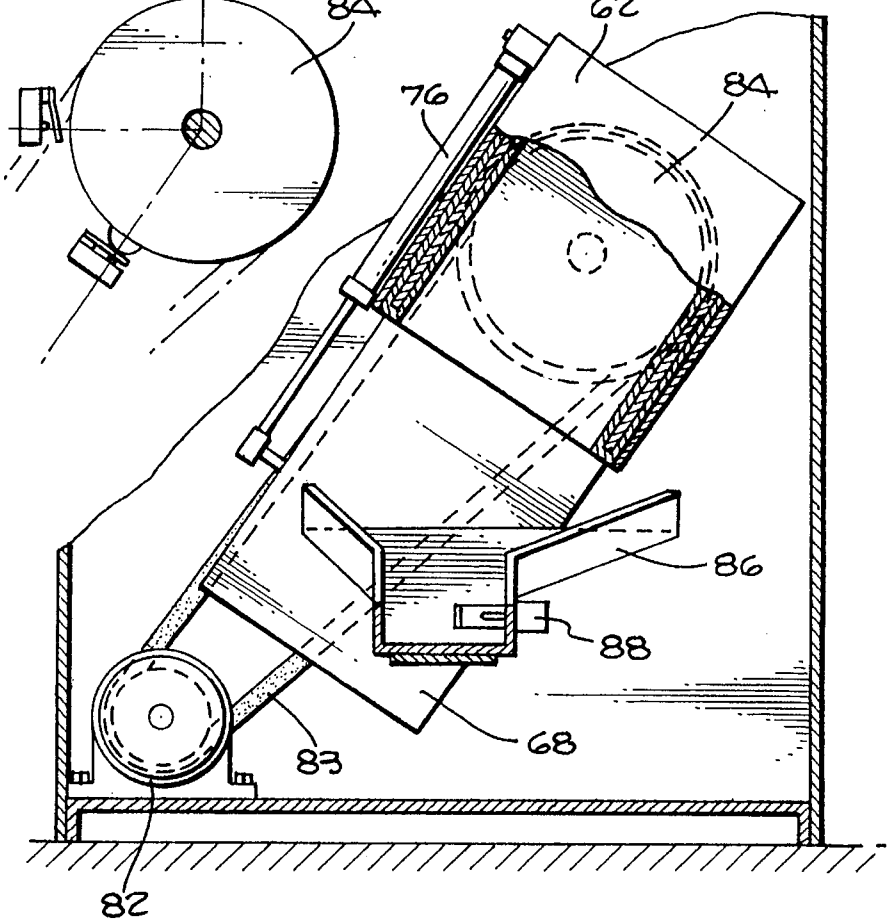
FIG. 13 is the partial sectional view into the side of the oven means associated with the present invention, as revealed by the section XIII—XIII taken in FIG. 12.
Figure 14:
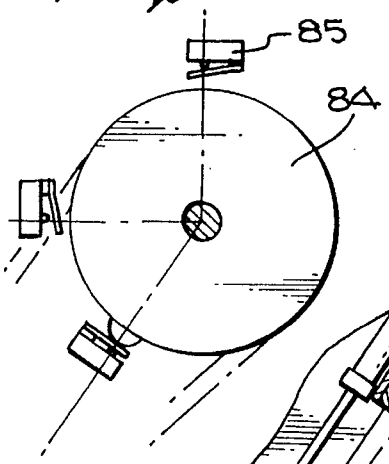
FIG. 14 is a partial sectional view looking into the means for controlling the position of rotation of the oven means, as revealed by the section XIV—XIV taken in FIG. 12.

In order to discharge the portion of heated food from machine 1, means are provided for catching and conveying the heated portion from enclosure 62 when it is in the downward-facing, door-open attitude (see FIGS. 12 and 13). In the embodiment illustrated, these comprise a chute 86 located below oven means 60 which has an expanded throat which both tapers inwardly and inclines downward towards opening 4 in the front of machine 1. Means are provided within chute 86 for verifying that the heated food portion has, in fact, been discharged from oven means 60 and out of the end of chute 86, and comprise a simple detector switch 88 located hear the mouth of chute 86 reporting to control and monitor means 110.

In order to receive currency into machine 1 and to authenticate and store it automatically, a conventional dollar bill changer 100 is incorporated, except modified as hereinafter described. In the exemplary embodiment illustrated, changer means 100 comprises the receiver mechanism from a conventional bill changer mechanism, which includes means for pulling a bill inserted into the changer into a scanning position, comparing it electro-optically with an exemplar having a predetermined authenticity and amount, and, in the event the bill is not authentic, or of an incorrect amount, rejecting it from the machine. In the event the bill is authentic, in its usual operation, the mechanism will then cause the coin changer to eject the appropriate amount of change in coin for the bill inserted. However, in the embodiment illustrated, the mechanism is modified such that, when a genuine bill of the appropriate amount is inserted within the machine, instead of making change, the mechanism signals control and monitor means 110 to initiate preparation of the food portion. Accordingly, in the embodiment illustrated, changer means 100 does not serve to make change, except in the cases where control and monitor means 110 have been advised that hopper means 10 is empty, or that a jam in the preparation cycle has occurred, in which case it signals the balance of modified changer means 100 to refund the patron's dollar deposit in an equivalent amount of change. Thus, it is anticipated that machine 10 will be primarily confined to sales of food portions having a price equal to $1, or low integer increments thereof. This results in a considerable simplification of the currency-receiving and-refunding mechanisms required for the machine, as no coin authentication or counting apparatus is required.

Control and monitor means 110 essentially comprise the logic circuitry necessary to initiate and monitor the food preparation cycle, including circuitry to receive a signal from changer means 100 that a predetermined amount of authenticated money has been inserted into machine 1, to open oven door 68 and rotate enclosure 62 into the upward-facing position, to activate dispenser means 20 to dispense a single portion into oven means 60, to verify that a portion has been dispensed therefrom, to rotate oven means 60 to a horizontally-facing position and close door 68, to initiate the heating or cooking cycle, and upon its completion, to open oven door 68 and rotate oven means 60 to the downward facing condition to discharge the heated portion from oven means 60 and out of machine 1 by gravity, and to verify that the heated portion has actually been discharged.

It is to be noted that monitor and control means includes means for verifying performance of each of the steps of the preparation cycle, i.e., that door 68 is properly opened or closed, that enclosure 62 is rotated into the appropriate position, that dispenser means 20 has actually dispensed a portion, that oven means 60 have been energized for cooking for the predetermined length of time, and that a heated food portion has actually been dispensed from machine 1. In the event any of the foregoing has not occurred, and in the proper sequence, control and monitor means 110 are appropriately signaled by the relevant detector, and changer means 100 are signaled to refund the patron's deposit in coin and to illuminate an "empty" indicator on the front panel of machine 1.

The balance of machine 1 comprises conventional supporting apparatus, including refrigeration means 120, including a compressor 122, refrigerant storage vessels 124, and a condenser 125, all of which are dedicated to maintaining the inventory of food portions within dispenser means 10 in a refrigerated or frozen condition. Additional support equipment includes an air compressor 126, as well as compressed-air storage vessels and filtration systems (not illustrated.) Skilled practitioners will readily recognize the preferability of a compressed air system for door actuation utilized in the instant invention over that of a hydraulic system incorporating typical hydraulic working fluids, in light of the proximity of the system to food preparation and the potential for contamination.

The foregoing system, as described, is adequate for servicing one or two single locations. However, it is contemplated that the machine of the present invention will lend itself well to being tended in large numbers by only a single individual. In order to reduce the level of required maintenance intervals, it is intended that machine 1 will be augmented with a computerized phone-in system, one version of which is sold under the trade name "SmartVendor". This module comprises essentially a digital microprocessor specifically, adapted to monitor and record system status on a continuous basis, and if properly connected with an existing telephone line, to "call home" in the event of a system malfunction. Additionally, using conventional telephonic interrogation equipment, a machine tender may obtain machine status, including remaining inventory, number of sales since last report, bin temperature, etc. from a remote location, such that the machine need not be visited on a daily basis unless maintenance is actually required. By use of this module in conjunction with the machine of the present invention, a single tender may efficiently manage a large number of machines over widespread locations.

Skilled practitioners will readily recognize that other modifications in material, apparatus, construction, and assembly are possible in connection with the machine of the present invention. Accordingly, the machine discussed and illustrated herein should be taken as exemplary in nature only, and the scope and spirit of the instant invention is to be limited only by the claims appended hereto.

What is claimed is:

1. An automatic hot food vending machine, comprising in combination:

hopper means for holding an inventory of uniformly sized, individual refrigerated or frozen portions of said food and for maintaining said inventory in a refrigerated or frozen condition;

dispenser means for selectively dispensing one of said portions from said inventory by gravity;

oven means for receiving said one portion from said dispenser means, for heating said portion by irradiation thereof with microwave energy for a predetermined length of time, and for discharging said heated one portion from said machine thereafter by gravity;

changer means for receiving, counting, authenticating, and storing money inserted into said machine, and for refunding counterfeit money inserted therein or genuine money upon command; and control and monitor means for:

receiving a signal from said changer means that a predetermined amount of said authenticated money has been inserted into said machine;

actuating said dispenser means upon receipt of said signal to dispense said one portion into said oven means; and activating said oven means to receive, heat, and discharge said portion from said machine, wherein said dispenser means further comprise:

said hopper means including a lower, inverted frusto-pyramidal chamber having a flat bottom with a generally semicircular opening therethrough guarded by a quadrant-shaped closure and defining an inwardly flanged lip about said opening, said opening having a diameter at least twice a largest dimension of one of said portions;

an upright conical member having a largest diameter about equal to that of said semicircular opening, said member being positioned generally centered within said chamber above and spaced apart from said opening;

a cylindrical pan having a diameter coextensive with said opening, an open top in communicating engagement with said opening, a depth below said opening, and a generally flat bottom having a quadrant shaped aperture therein in vertical alignment with said quadrant-shaped closure defining a dispenser opening;

a shaft rotatably-mounted coaxially within said semicircular opening and extending from above said opening, through said pan, to below said bottom of said pan;

a quartet of elongated rollers extending radially outward from said shaft in even distribution within a common plane normal to said shaft and rotatably journaled thereon for rolling movement of an outer portion of each said rollers upon an upper surface of said flanged lip above said semicircular opening;

a paddle wheel having four paddles, each said paddle extending radially outward from said shaft in alignment with one of said rollers and having a width and radial extent sufficient to sweep substantially all of a quartic volume defined within said pan between adjacent said paddles into alignment with said dispenser opening upon successive 90° incremental rotations of said shaft; and means for selectively rotating said shaft through said successive 90° incremental rotations when actuated.

2. The machine of claim 1, wherein said dispenser means further comprise:

means for detecting each said successive 90° incremental rotation of said shaft and for deactivating said dispenser means upon detection thereof.

3. The machine of claim 1, wherein said dispenser means further comprise:

means for detecting whether or not said portion of food has been dispensed from said dispenser means after one of said 90° incremental rotations, for advising said control and monitor means thereof, and for reactivating said dispenser means if not.

4. The machine of claim 3, further comprising:

means for detecting whether or not said portion of food has been dispensed from said dispenser means after a predetermined number of said successive 90° incremental rotations of said shaft, and for refunding an amount of said money from said changer means if not.

5. The machine of claim 4, further comprising:

means for notifying a remote location that said portion of said food has not been dispensed from said dispenser means after a predetermined number of said successive 90° incremental rotations of said shaft.

6. The machine of claim 1, wherein said oven means further comprises:

an enclosure shielded against passage of microwave energy therefrom, said enclosure having a face with an opening therethrough, said opening being guarded by a shielded door hingeably-attached to said enclosure over said face for movement between opened and closed positions, said enclosure being rotatably-journaled about a horizontal axis for rotation between an upward facing position below said dispenser means opening, a horizontally-facing cooking position, and a downward facing discharge position;

means for opening said door and for rotating said enclosure to said upward-facing position to receive said one portion from said dispenser means;

means for rotating said enclosure to said horizontally-facing position and for closing said door; means for radiating microwave energy into said closed enclosure for said predetermined length of time to heat said one portion;

means for opening said door and for rotating said enclosure to said downward-facing position to discharge said heated one portion therefrom by gravity; and means for catching and conveying said one heated portion from said enclosure to an exterior opening in said machine by gravity.

7. The machine of claim 6, wherein: said dispenser means further comprises a chute adapted to catch and convey said one portion from said dispenser means opening to said enclosure opening; and said means for catching and conveying said one heated portion from said enclosure to said exterior opening in said machine further comprises: a chute adapted therefor.

8. The machine of claim 6, further comprising:

means for detecting each said successive 90° incremental rotation of said shaft and for deactuating said dispenser means upon a detection thereof;

means for detecting whether or not said portion of said food has been dispensed from said dispenser means after one of said 90° incremental rotations of said shaft, for advising said control and monitor means thereof, and for reactuating said dispenser means if not;

means for detecting whether or not said portion of food has been dispensed from said dispenser means after a predetermined number of said successive 90° incremental rotations of said shaft and for refunding an amount of said money from said changer means if not; and means for detecting whether or not said one heated portion has been discharged from said machine and for refunding an amount of said money from said changer means if not.

9. The machine of claim 8, further comprising:

means for notifying a remote location that said portion of said food has not been dispensed from said dispenser means after a predetermined number of said successive 90° incremental rotations of said shaft; and means for notifying a remote location that said one heated portion has not been discharged from said machine.

* * * * *

UNITED STATES PATENT AND TRADEMARK OFFICE

CERTIFICATE OF CORRECTION

PATENT NO. : 5,598,947

DATED : February 4, 1997

INVENTOR(S) : Smith

It is certified that error appears in the above-identified patent and that said Letters Patent is hereby corrected as shown below:

In column 4 at line 13, please delete " 80 " and insert -- 30 --.

Signed and Sealed this

Seventh Day of April, 1998

Bruce Lehman

*Attest:*

BRUCE LEHMAN

*Attesting Officer*

*Commissioner of Patents and Trademarks*